United States Patent [19]

Goutille

[11] Patent Number: 4,836,395

[45] Date of Patent: Jun. 6, 1989

[54] LARGE DISPOSABLE CONVERTIBLE PACKING CASE

[75] Inventor: Maurice Goutille, Lamorlaye, France

[73] Assignee: Weidmann & Pittet S.A., Geneva, Switzerland

[21] Appl. No.: 180,709

[22] Filed: Mar. 30, 1988

Related U.S. Application Data

[63] Continuation of Ser. No. 828,450, Feb. 11, 1986, abandoned.

[30] Foreign Application Priority Data

Feb. 14, 1985 [FR] France ..... 85 02109

[51] Int. Cl.[4] ..... B65D 87/00

[52] U.S. Cl. ..... 220/1.5; 220/4 F

[58] Field of Search ..... 220/1.5, 4 F, 72.1, 220/84

[56] References Cited

U.S. PATENT DOCUMENTS

| | | | |
|---|---|---|---|
| 2,191,445 | 2/1940 | Armington | 220/1.5 |
| 2,317,985 | 5/1943 | Fitch et al. | 220/1.5 X |
| 3,459,326 | 8/1969 | Betjemann | 220/1.5 |
| 3,515,303 | 6/1970 | Robertson et al. | 220/1.5 X |
| 4,506,798 | 3/1985 | Goutille | 220/4 FX |

*Primary Examiner*—Steven M. Pollard

*Attorney, Agent, or Firm*—Martin Smolowitz

[57] ABSTRACT

A standard rigid load-bearing metal framework for a convertible disposable packing case is made up of a bottom frame (1), a top frame (2), corner supports (3, 4) for joining these two frames (1, 2), and stiffeners (5, 6, 10) all assembled together by mechanical fixing means. This framework withstands all the mechanical stresses by itself and panels forming the sides, top and ends of the packing case are not subjected to these stresses. The packing case has the advantage that it can be supplied with its elements in a collapsed form and not yet assembled, and that it is inexpensive, while at the same time having the main advantages of standard containers.

8 Claims, 6 Drawing Sheets

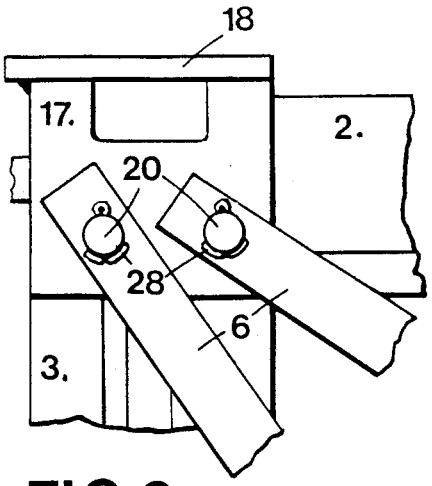
FIG.6a
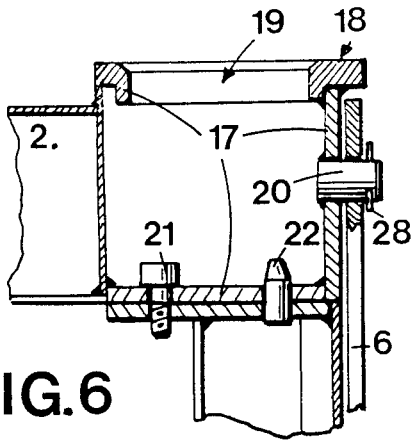
FIG.6
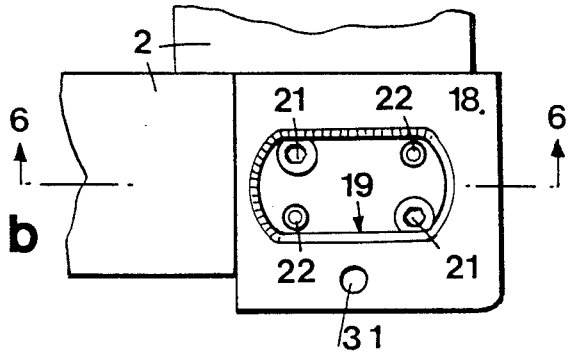
FIG.6b
FIG.7
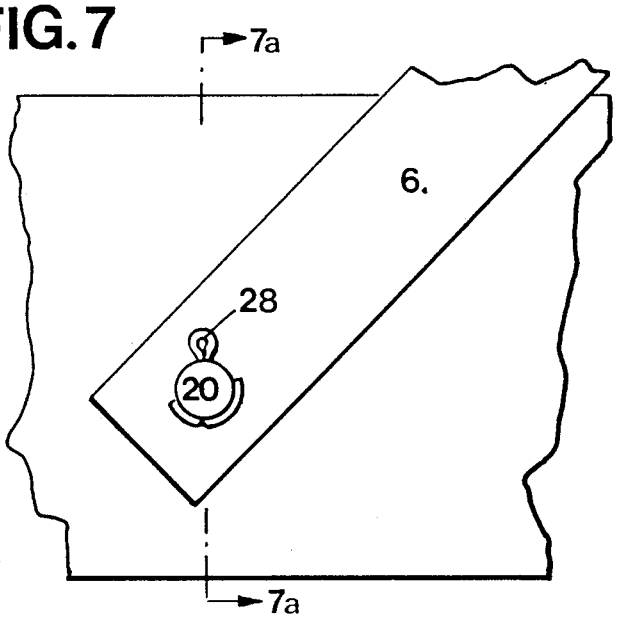
FIG.7a
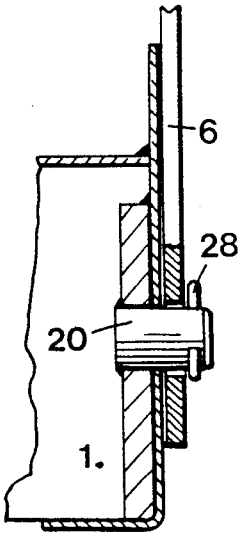

LARGE DISPOSABLE CONVERTIBLE PACKING CASE

This application is a continuation, of application Ser. No. 828,450, filed 2/11/86 abandoned.

BACKGROUND OF THE INVENTION

The common technique employed for transporting large objects, such as machines, vehicles etc., in some form of packing over long or short distances, is to use a wooden or plywood shipping case when conditions do not permit the use of metal containers conforming to ISO (International Standard Organization) standards. Such wooden or plywood shipping cases are used especially in the following instances: despatch to distant destinations and when it is not certain that the containers will be returned to the shipper, and the need for the goods to be stored for a relatively long period on arrival before they are unloaded (the daily charge for immobilizing the container is high), the fact being that, in these instances, the containers would be immobilized too long or it may even be impossible to recover them (containers are expensive).

Nowadays, to avoid paying the high costs of long-term immobilization of standard metal containers and even losing money if they are not returned, shippers are therefore forced to use shipping cases which are most frequently constructed at the loading sites in the factory and which have a high cost price per cubic meter of volume. Moreover, for large business concerns, this necessitates an additional workshop and additional labor specially for manufacturing these shipping cases, which represents a substantial and permanent increase in the general costs.

SUMMARY OF THE INVENTION

The present invention overcomes these disadvantages and relates to a large disposable convertible packing case which has a rigid load-bearing metal framework consisting of elements assembled by mechanical fixing means, and designed to withstand by itself all a contained mechanical stresses due to the load, handling and transportation. This packing case structure comprises a rectangular bottom frame, vertical corner supports, a top frame and stiffeners for distributing the forces and joining these two frames together by mechanical fixing means, the sides and the top being closed with panels fixed to the metal structure. The packing case elements are supplied in a collapsed kit form, and are assembled together to provide the packing case framework structure.

BRIEF DESCRIPTION OF THE DRAWINGS

By way of an example, the attached drawings show an embodiment of the packing case according to the invention.

FIG. 6 is a view in partial section, along line 6—6 of FIG. 6*b*, showing means for assembling the vertical corner supports to the top frame of the packing case.

FIG. 6*a* is an external view of the detail according to FIG. 6.

FIG. 6*b* is a plan view corresponding to FIG. 6.

FIG. 7 is an external view of a detail, showing the fixing, to the bottom, of a stiffener belonging to the metal structure of the packing case.

FIG. 7*a* is a sectional view along line 7*a*—7*a* of FIG. 7.

DESCRIPTION OF PREFERRED EMBODIMENT

Figure 1:
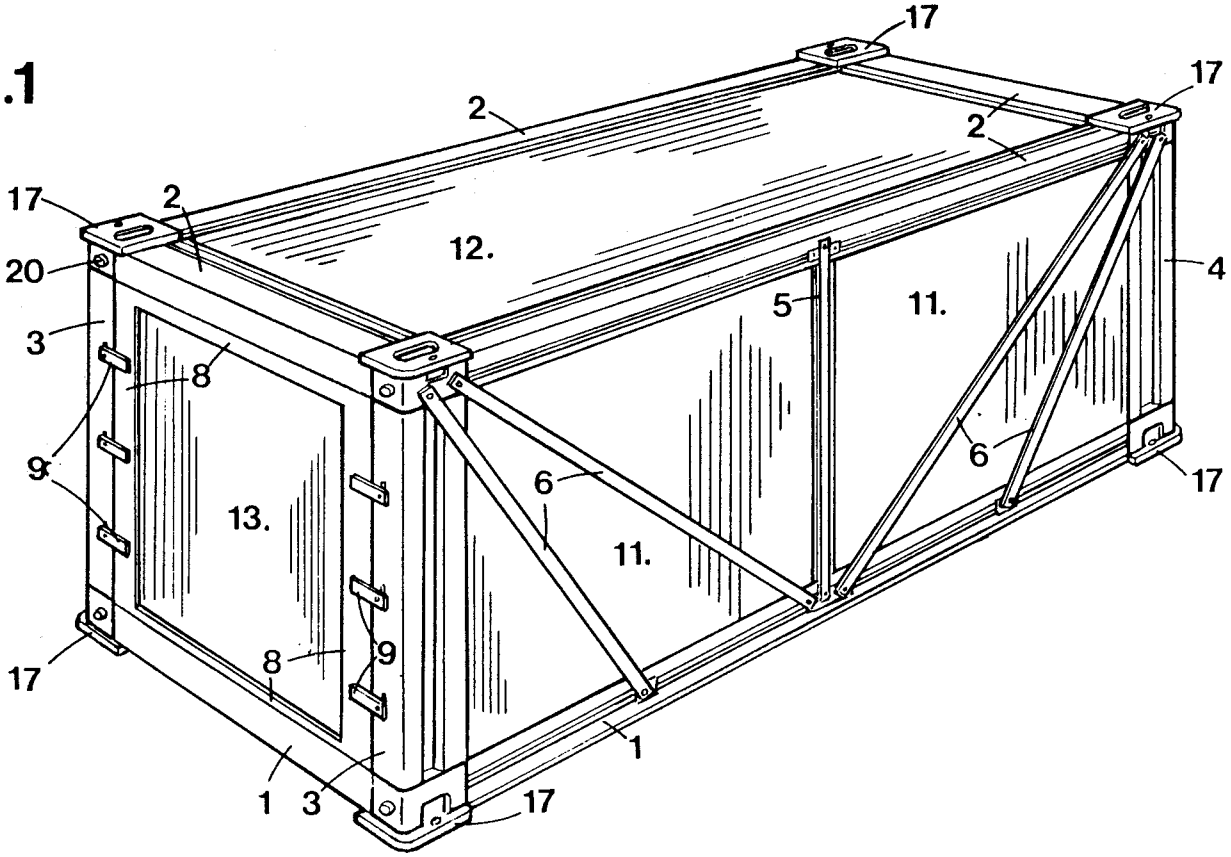
FIG. 1 is a perspective view of this embodiment ready for transportation with a load (not shown) inside the case.

The closed assembled packing case shown in FIG. 1 comprises a metal framework (which will be described in detail later) consisting of elements assembled by mechanical fixing means, this framework being designed to withstand by itself all the mechanical stresses due to the load inside the packing case and to the handling and transportation of the loaded packing case.

This packing case according to FIG. 1 also comprises wooden, plywood, fiberboard or plastic panels, or even sheet metal panels, which, as will be seen later, are fixed to the metal framework so as to ensure that the packing case closes tightly and that its contents cannot be tampered with. These panels are not therefore subjected to the mechanical stresses which have just been mentioned; these stresses are withstood exclusively by the metal framework.

Figure 2:
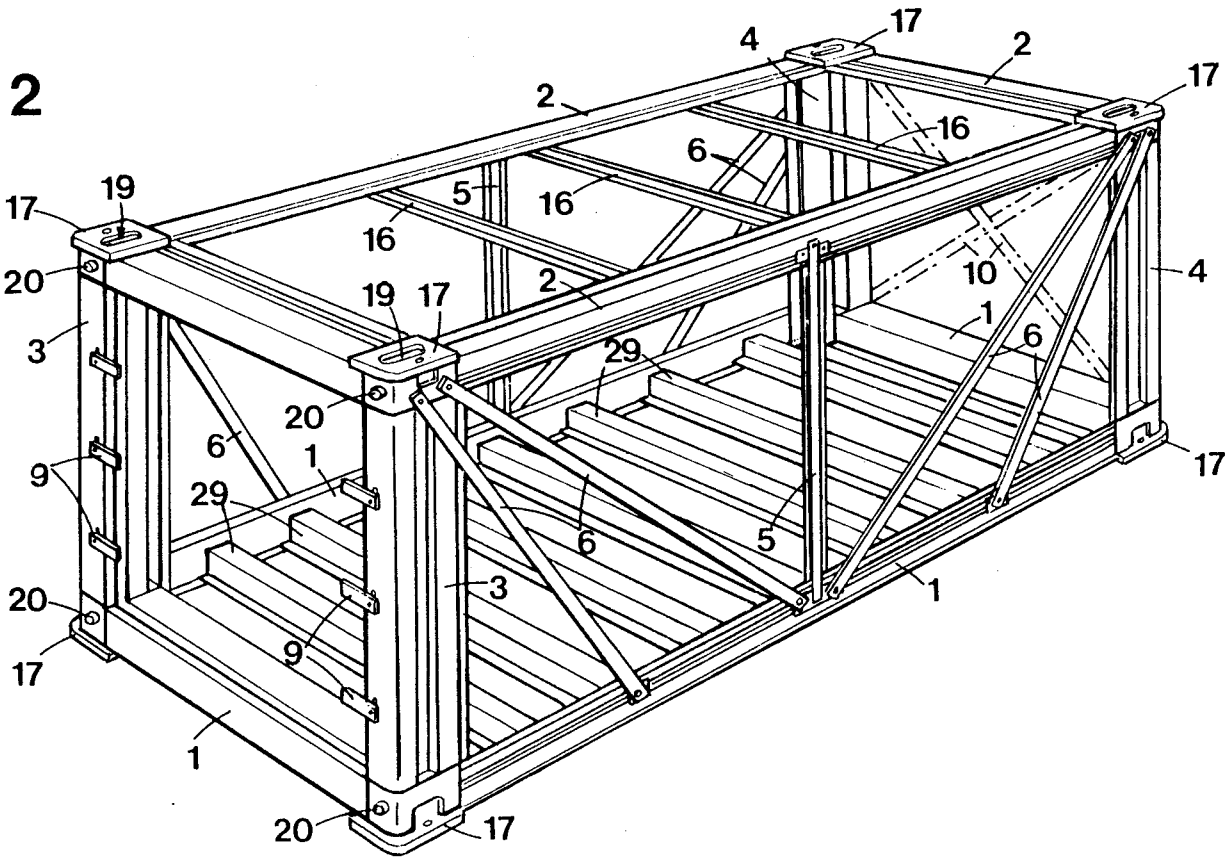
FIG. 2 is a perspective view, analogous to FIG. 1, showing only the metal structure of this embodiment.

FIG. 2 shows the assembled metal framework without any of the panels. This framework comprises the following parts: a bottom frame 1, a top frame 2, two vertical corner supports 3 joining the frames 1 and 2 at one end, where a door will be provided, two vertical corner supports 4 joining the frames 1 and 2 at the opposite end of the framework, two vertical center stiffeners 5 joining the frames 1 and 2, and oblique stiffeners 6 joining the frames 1 and 2 and ensuring the distribution of forces.

The front end (in the drawing) of the packing case is provided with a door whose wooden frame 8, shown in the drawing, is fixed (after loading) to the supports 3 by catches 9 pivoting on the supports 3. A lead seal (not shown) on the door closed by these catches 9 ensures that the contents cannot be tampered with.

The opposite end of the packing case does not have any special means except for two diagonal stiffeners 10, which are shown in dot-and-dash lines in FIG. 2.

As already indicated, the side faces, the back face, the door and the top frame are provided with tightly closing panels. These panels are shown in FIGS. 1 and 3 to 5 by reference numbers 11 (sides), 12 (top), 13 (door) and 14 (end opposite the door). These panels are preferably fixed to the metal parts of the framework with nails by means of a special tool such as, for example, the one available commercially under the brand name "Hilti", or with rivets. A gasket 15 is placed between the frame of the door 8 and the supports 3 and the short sides of the frames 1 and 2. A similar gasket (not shown) is placed between the panels 11, 12 and 14 and the metal parts to which they are fixed.

Figure 3:
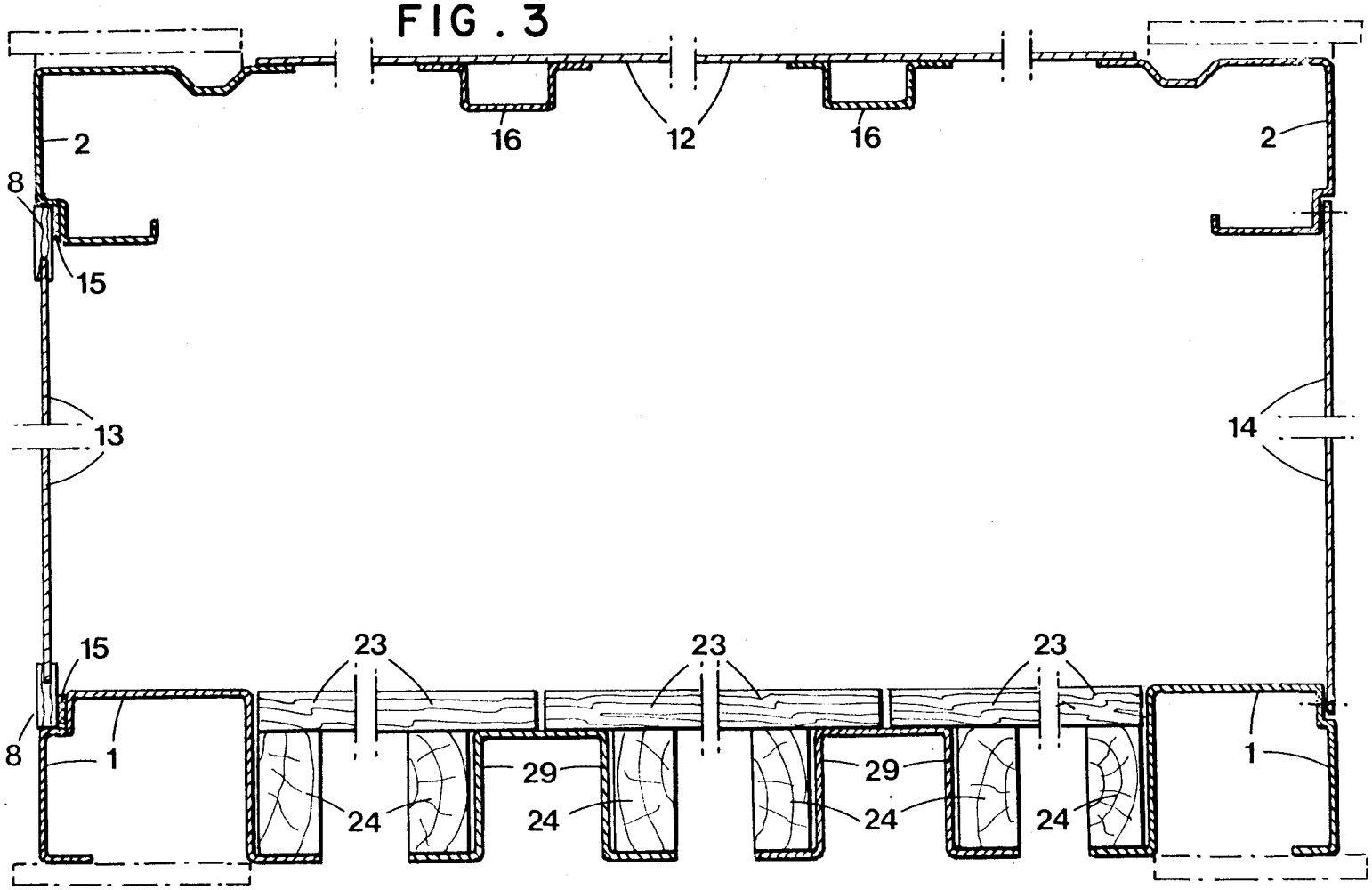
FIG. 3 is a view of the packing case in longitudinal vertical section.
Figure 4:
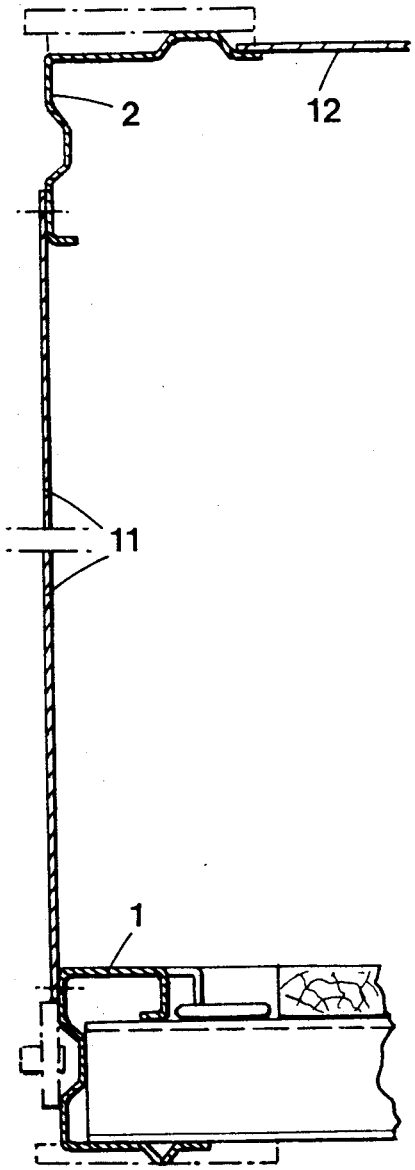
FIG. 4 is a view of one end of the packing case in partial vertical section.
Figure 5:
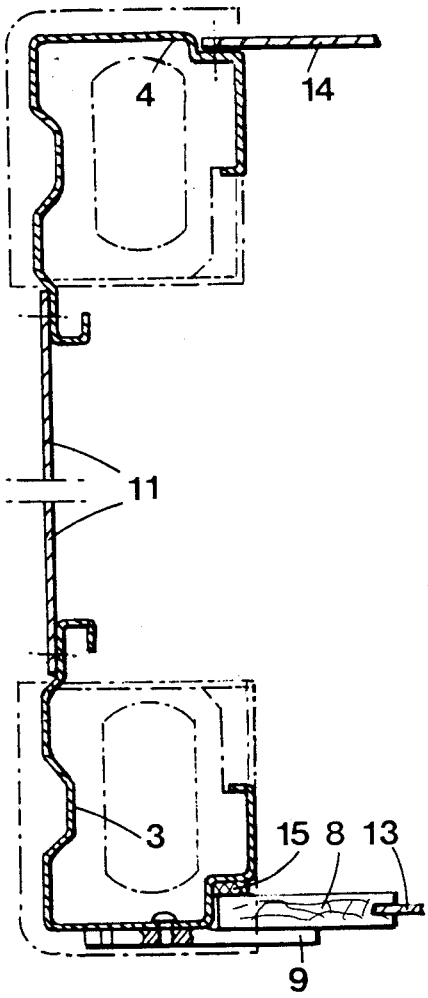
FIG. 5 is a view of one end of the packing case in partial horizontal section.

The top frame 2 comprises parallel crosspieces 16 fixed at their ends to the long side pieces of this frame. They support the top panel 12, as shown in FIG. 3. Their cross-sectional shape is approximately that of an upturned omega and the panel 12 rests on the feet of the omega.

At its four corners, the bottom frame 1 has corner pieces 17 with a standard face. The top frame 2 also has a corner piece 17 at each corner. These corner pieces are made of steel and possess standard openings in their (standard) lower face 18 for the bottom frame 1 and (standard) upper face 18 for the top frame 2. These openings are shown by reference number 19 and are used for the following purposes: gripping of the packing case by handling gear, for example by means of twist-locks, and stowage on a carrier truck or vehicle, or on the deck of a cargo ship, by means of the said twist-locks.

These openings 19 provide access to the screws 21 for fixing the corner pieces 17 to the supports 3 or 4. For this purpose, the upper and lower parts of these supports have two threaded holes for receiving screws 21 joining the corner piece 17 to the end of a support. Two (permanently fixed) locating pegs 22 are provided on the ends of these supports and are designed to cooperate with corresponding holes in the corner piece in order to ensure the exact relative positioning of each corner piece and the corresponding support before the fixing screws 21 are inserted.

The upper ends of the stiffeners 6 (FIGS. 2 and 6, 6*a*) and 10 are fixed to the upper corner pieces 17. The lower end of these stiffeners is fixed to the long sides of the bottom frame 1 (FIGS. 1 and 7, 7*a*). The diagonal stiffeners 10 are fixed to the corner pieces. These various stiffeners are fixed, so as to be easily removable, by means of studs 20 welded to the frames 1 and 2, a hole at each end of the stiffeners 6 and 10 fitting over the said studs. A pin 28 holds the stiffeners in place on the studs 20.

The base has a set of parallel crosspieces 29 welded at their ends to the long sides of the bottom frame 1. The cross section of these crosspieces is approximately omega-shaped (FIG. 3). The floor of the base is made up of pallets each consisting of a wooden board 23 rigidly joined to several supporting planks 24 which rest on lateral feet belonging to the crosspieces 29.

The metal framework made up of the pieces 1, 2, 3, 4, 5, 6 and 10 and the crosspieces 16 and 29 forms a rigid assembly which withstands by itself all the mechanical stresses due to the load and to the handling and transportation of the packing case. The sides 11, top 12, door 13 and opposite end 14 are not subjected to stresses. Of course, to handle a packing case of this type by means of a crane, for example, it is necessary to use a rigid intermediate frame made of steel, which ensures that the forces are exerted vertically on the supports 3 and 4 and that any horizontal components is excluded.

It will be noted that the corner supports 3 and 4 and the stiffeners 6 and 10 are easy to assemble with the frames 1 and 2 and that the sides 11, top 12 and door 13 are easy to fix to the framework. All these elements can be supplied to the user in the collapsed form of a kit. FIGS. 8 to 11 show the constituent elements of packing cases, such as the one which has just been described, in the collapsed form prior to assembly.

Figure 11:
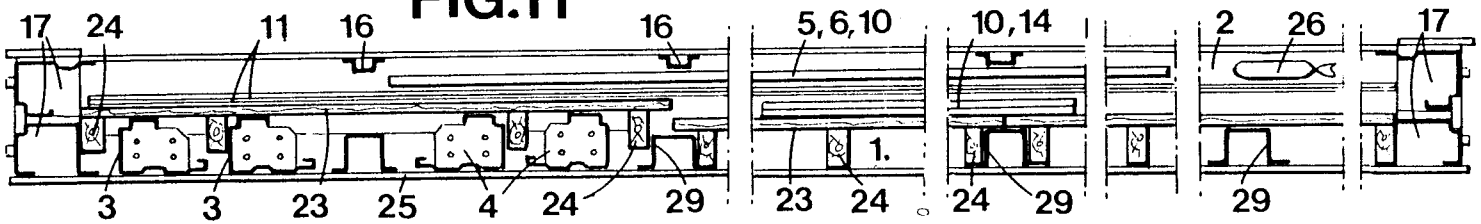
FIG. 11 shows, in longitudinal section and on a larger scale, a packing case whose constituent elements are collapsed, as seen from the outside in FIG. 8.

FIG. 11 shows a collapsed packing case. On the left, the four supports 3 and 4 rest on the bottom frame 1 and a pallet 23, 24 rests on these supports. A bottom panel 25 (not shown in the previous figures) is permanently fixed to the underside of the frame 1. These pieces rest on this bottom panel. On the right, FIG. 11 shows the other pallets 23, 24 forming the bottom, which, as in FIG. 3, rest on the crosspieces 29. The panels 11, 12 and 14, the door 13, the stiffeners 5, 6 and 10 and also a bag 26 containing the screws, pins and gasket materials have been placed on the various pallets.

Figure 9:
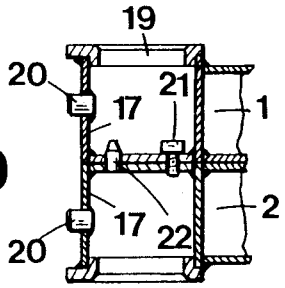
FIG. 9 is a view of a detail, in longitudinal section and on a larger scale, showing the means for fixing the packing case bottom frame and the top frame together in the collapsed position.
Figure 8:
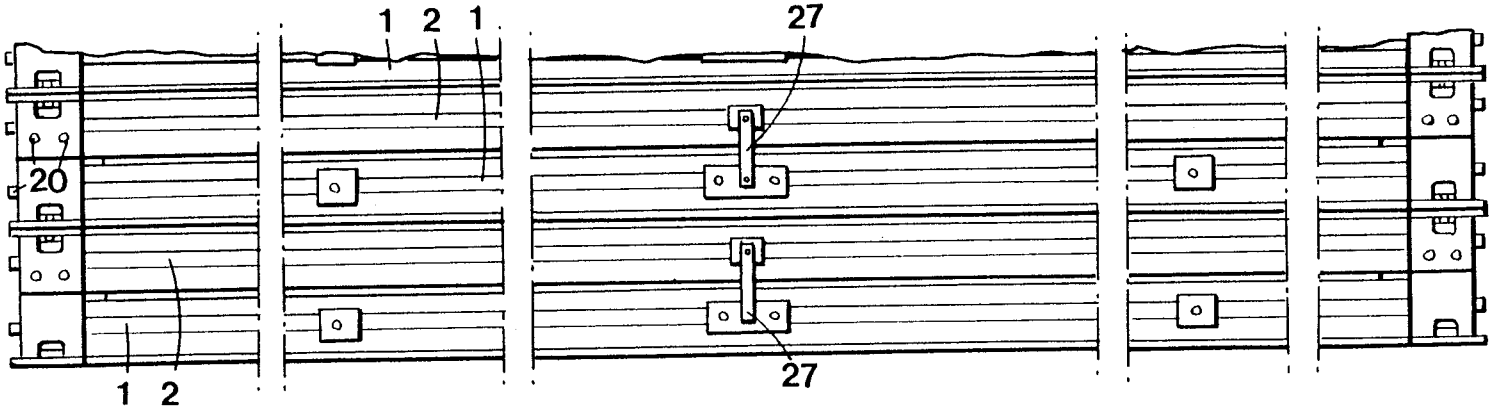
FIG. 8 is a side view of several collapsed packing cases placed on top of one another and fixed together to form a transportable stack.

The top frame 2 has been placed on top of all these parts, so that the detached pieces for assembly are enclosed between these frames. The frames 1 and 2 are fixed in the collapsed position by means of the same screws 21 (FIG. 9). The kits are joined together by means of four corner bolts 30 (FIG. 10), which are threaded through the holes 31 (FIG. 6*b*) in the standard plates 18. The lugs 27 (FIG. 8) connect together each adjacent bottom frame 1 and top frame 2 intermediate their corner pieces 17 and are stiffeners for the kits. The assembly shown in FIG. 11 forms one kit or one collapsed packing case. FIG. 8 shows several kits or collapsed packing cases placed on top of one another and joined together to form a stack of eight kits, the volume of which is equal to that of one assembled packing case. Thus, the packing cases are delivered to the users simply by truck or rail, thus relieving them of the need to have a special workshop for manufacturing shipping cases. Assembly of the packing case is simple and can be carried out by the user.

Figure 10:
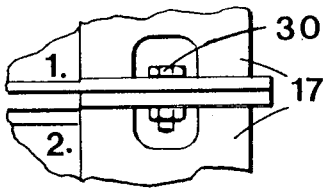
FIG. 10 is an analogous view of the means for fixing two collapsed packing cases per FIG. 9 together.

The kits are joined together (FIG. 8) by fixing the four corner pieces 17 of the bottom frame 1 of one kit to the four corner pieces 17 of the top frame of the same kit by means of screws 21, as shown in FIGS. 9 and 10. These are the same screws as those used to join the corner pieces 17 to the supports 3 and 4 when the packing case is assembled.

Load-securing pieces of a known type, for example in the form of rings, can advantageously be fixed to the bottom frame, as is customary in containers.

The external dimensions of the packing case described are standard, i.e. they conform to the specifications laid down by ISO (International Standard Organization), which brings the same advantages in transportation as ISO containerization. At the same time, said packing cases are disposable and hence inexpensive and entirely at the disposal of the carrier and the consignee, with no time restriction.

The packing case described therefore offers the advantage of a large loading volume, vertical handling, transfer without interfering with the load (i.e. without unloading and reloading the goods during transportation), suitability for loading on deck or via the sliding rails of container ships' holds, reduced transportation costs at the container tariff, and securing to the twist-locks on freight cars, container trucks and cargo decks.

What is claimed is:

1. A large disposable convertible packing case which has a rigid load-bearing metal framework consisting of elements assembled by mechanical fixing means, and designed to withstand by itself all the mechanical stresses due to a contained load, handling and transportation, the case structure comprising:

a rectangular shaped bottom frame (1) made of four side pieces and a plurality of cross pieces (29) rigidly attached to two opposite side pieces, said bottom frame (1) having a corner piece (17) rigidly attached at each corner thereof;

a rectangular shaped top frame (2) made of four side pieces and a plurality of metallic cross bars (16) welded to two opposite side pieces, said top frame (2) having a corner piece rigidly attached at each corner thereof;

four vertical corner supports (3,4) joining together said bottom and top frames, said corner supports each being removably attached to the corner pieces by at least one locating peg (22) and at least one screw fastener (21);

stiffeners (5, 6, 10) being provided for additional joining said bottom and top frames (1,2) together and for distributing the loading forces therebetween, the sides and the top of the case structure being closed with a plurality of panels (11,12,13,14) each fixed to the metal structure by fasteners located near the panel edges and driven through the panels into the metal elements forming the structure, each said stiffener (6) being removably attached to said bottom frame (1) and said top frame (2) external to said panels by a stud (20) rigidly attached to each said frame, a opening in each end of the stiffener being fitted over the stud and held by a pin (28).

2. The packing case as claimed in claim 1, wherein the corner pieces (17) each have a plate (18) rigidly attached thereto, each said plate (18) possessing a standard orifice opening (19), which for the corner pieces of the top frame (2) permits vertical handling of the packing case with a container spreader, and for the corner peices of the bottom frame (1) enables the packing case to be secured either on an identical packing case for stacking purposes or on twistlocks on a vehicle.

3. The packing case as claimed in claim 1, wherein said bottom frame (1) metal cross pieces (29) are welded to its longer opposite sides, said cross pieces having an omega-shaped cross-section, and wherein said bottom frame has floor pallets (23,24) resting on lower parts of said crosspieces (29).

4. The packing case as claimed in claim 1, wherein the constituent elements including the lower and upper frames (1,2), corner supports (3,4), the stiffeners (6,10), mechanical assembly elements and the panels (11,14) are grouped together prior to assembly, and are housed in a closed space formed between the bottom frame (1) on which they rest, and the top frame (2), screw means (21) and peg means (22) being provided for joining said two frames (1,2) so as to form a collapsed packing case, and the corner pieces (17) being designated so that two to eight collapsed packing cases placed on top of one another can be joined together by means of assembly members (30) attached to each adjoining said corner piece.

5. The packing case as claimed in claim 4, wherein the adjacent frames (1,2) of each case are attached together by lug means (27) located intermediate opposite ends of the frames.

6. The packing case as claimed in claim 1, wherein a door having a frame (8) is provided at one end of the case structure between two of said corner supports, and a gasket (15) is provided between said frame (8) and the two corner supports.

7. The packing case as claimed in claim 1, wherein said top frame (2) metal cross pieces (16) are welded to its longer opposite sides, said cross pieces having an upturned omega crosssectional shape with said top panel (12) resting on the flange portion.

8. A large disposable standardized packing case having a rigid load bearing metal framework composed of elements assembled by mechanical fixing means and designed to withstand by itself all mechanical stresses due to a contained load, handling and transportation, the case structure comprising:

a rectangular shaped bottom frame (1) made of four metallic side pieces and a plurality of metallic parallel cross pieces (29) welded to the side pieces for receiving a load, said bottom frame (1) being provided with four corner pieces (17), and having a floor (23) lying on said frame (1);

a rectangular shaped top frame (2) made of four metallic sectioned side pieces and a plurality of metallic cross pieces (16) welded to said side pieces, said top frame (2) being provided with four corner fittings (17), four vertical metallic corner supports (3,4) each bolted at its lower end to said corner pieces (17) thus enabling bringing the load on the floor (23) through spaces between said corner supports;

panels (11,12,13,14) for closing the spaces between said bottom frame, top frame and corner supports to provide four vertical walls and a roof, said panels being fastened to said frames and corner supports by nails passing through said panels near their edges; and stiffeners (5,6,10) additionally joining together said bottom and top frames (1,2) and for distributing the loading forces therebetween, said stiffeners (6) being removably attached on said bottom and top frames (1,2) and to the corner fittings (17) and being located outside said closing panels (11, 12, 13, 14) by a stud (20) rigidly attached to each said frame and an opening provided in each end of said stiffener (6) being fitted over the stud (20) and held by a pin (28), so that access to the load after transportation requires first removing the fasteners of at least one wall and then removing the panel(s) of said wall, the whole of the assembled bottom frame, top frame, corner supports and stiffeners forming a rigid metallic structure capable of bearing by itself all of the mechanical stresses due to the handling and the transportation of the case with the contained load.

* * * * *